United States Patent [19]

Fabian et al.

[11] 4,048,831

[45] Sept. 20, 1977

[54] TWO-ROLLER DRIVING DEVICE

[75] Inventors: Wolfgang Fabian, Dortmund, Hombruch; Konrad Klein, Dortmund, Wambel; Theodor Sevenich, Dortmund, all of Germany

[73] Assignee: Hoesch Werke Aktiengesellschaft, Dortmund, Germany

[21] Appl. No.: 739,706

[22] Filed: Nov. 8, 1976

Related U.S. Application Data

[63] Continuation of Ser. No. 603,945, Aug. 12, 1975, abandoned.

[30] Foreign Application Priority Data

Aug. 13, 1974 Germany ..... 2438759

[51] Int. Cl.[2] ..... B21B 39/12

[52] U.S. Cl. ..... 72/251; 226/177; 226/180; 226/194

[58] Field of Search ..... 226/176, 177, 180, 181, 226/186, 194; 72/251

[56] References Cited

U.S. PATENT DOCUMENTS

| | | | |
|---|---|---|---|
| 3,147,901 | 9/1964 | Nordman et al. | 226/186 |
| 3,310,210 | 3/1967 | Reib | 226/176 |
| 3,349,981 | 10/1967 | Hawkins et al. | 226/181 |
| 3,422,649 | 1/1969 | Lowy | 72/251 |
| 3,656,677 | 4/1972 | Stepanek et al. | 226/180 |

*Primary Examiner*—Robert W. Saifer
*Attorney, Agent, or Firm*—Walter Becker

[57] ABSTRACT

For use in connection with an underground reel in a rolling mill for band-shaped rolling stock, a two-roll driving device, with an upper driving roll and a lower driving roll which are arranged one above the other. When looking in the direction in which the rolling stock enters the reel, the axle of the upper driving roll is during the entry of the start of the rolling stock into the reel located behind the axle of the lower driving roll and after the start of the band-shaped rolling stock has been grasped by the winding mandrel of the reel the upper driving roll is pivotable into a position vertically above the axle of the lower driving roll, while behind the lower driving roll there is provided a deviating device for the band-shaped rolling stock. The upper driving roll is journalled in a stand which is pivotable about the axis of the lower driving roll and adjustable relative to the latter. A frame supporting the pivotable stand has arranged thereon a horizontally displaceable deviating flap which is movably connected to the stand.

8 Claims, 5 Drawing Figures

TWO-ROLLER DRIVING DEVICE

This is a continuation application of Ser. No. 603,945, filed Aug. 12, 1975 and now abandoned. The present invention relates to a two-roller driving device associated with an underground reel in a rolling mill for band-shaped rolling material, especially a wide band rolling mill, which driving device comprises an upper and a lower driving roller which are journalled vertically one above the other. The axis of the upper driving roller is, viewed in the direction of movement of the band at the band inlet into the reel, located behind the axis of the lower driving roller and after grasping the start of the band is by means of the winding mandrel of the reel pivotable vertically above the axle of the lower driving roller and while therebehind a deviating device for the band is provided.

Two-roller driving devices of the above mentioned type are known with which the axle of the upper driving roller is during the movement of the band pivotable from the position behind the axle of the lower driving roller into a position vertically above the axle of the lower driving roller. Such pivoting of the upper driving roller has proved advantageous for the winding of the bands. This known device, however, has the drawback that the upper driving roller can be pivoted merely between two positions which have to be fixed during the construction, and that the gap for the pressing-on pressure between the upper and lower driving roller changes during the pivoting operation. A further drawback consists in that with the heretofore known devices, the band can move only into the reel when the upper driving roller is pivoted toward the rear because only then the deviating device will engage the upper driving roller.

There has furthermore become known a three-roller driving device which is associated with a reel for band-shaped rolling material and with guiding means for the incoming band end directed toward said reel. With this device, two of the driven rollers are located above the upper band side and are by a common carrier and through cylinder piston transmissions engaging the same variable as to height while occupying differently spaced positions from the driving roller below the band. With this heretofore known device, the carrier is arranged above the band and is designed as a coupling bar receiving the roller axles. The coupling bar has its ends respectively connected to piston cylinder transmissions which are adapted to be actuated individually and independently of each other. Also with this known driving device, it is not possible during the pivoting of the upper two driving rollers to maintain a precisely defined gap or precise pressing force between the rear upper driving roller and the lower driving roller. Furthermore, the distance between the last lower roller bed roller and the lower driving roller must be kept rather great which fact, with thin bands has an unfavorable effect upon the inlet movement of the band and causes disorders.

It is, therefore, an object of the present invention to provide a two-roller driving device of the above mentioned general type which will overcome the above mentioned drawbacks and in which the upper driving roller can within a predetermined pivoting range be fixedly adjusted at any desired point during the passing through of the band as well as during the movement of the band into the reel, and in which the gap between the upper and lower driving roller and thereby the pressing force cannot change over the entire pivoting path.

It is a further object of this invention to provide a device of the type set forth in the preceding paragraph which will be simpler and safer and will permit a fast exchange of the entire driving device in case of damage occurring to the driving roller surfaces.

These and other objects and advantages of the invention will appear more clearly from the following specification in connection with the accompanying drawings, in which.

The driving device according to the present invention is characterized primarily in that the upper driving roller is mounted in a stand which is pivotable about the axis of the lower driving roller toward the lower driving roller which is mounted in a frame, and is furthermore characterized in that a deviating flap which is horizontally displaceable in the frame is movably connected to the stand.

According to a further development of the driving device according to the invention, the mounting of the stand is on the outside connected to an intermediate bushing into which are built the bearing bodies of the lower driving roller while the intermediate bushings are mounted in the frame and are held therein by bearing covers. The pivoting movement of the stand is limited by abutments which are connected to the frame. For adjusting the gap required between the upper and lower driving rollers, advantageously one air or hydraulic cylinder each is arranged on the stand on both sides thereof. This cylinder is through connecting rods directly connected to the inserts of the upper driving roller. Below the inserts, bearings in the form of wedge-shaped members are provided which are arranaged on a threaded spindle and are movable by means of a motor. For purposes of pivoting the stand and thereby the upper driving roller, advantageously in front of said stand, when viewing in the direction of movement of the band through the device, one hydraulic cylinder each is arranged on both sides. This cylinder is pivotally arranged on the frame and its connecting rod is joined to the stand. In this way, by a simple interruption of the supply of liquid to the hydraulic cylinders, the stand can be held stationary in any position between the two outer layers.

According to a further development of the invention, an oblong hole guiding means is provided in the frame, in the direction of movement of the band through the device, behind the lower driving roller, for mounting and guiding a roller bed roller. On the bearing body of the roller bed roller there is journalled a pivotable flap which is adapted to be controlled by means of a lever system which is connected to a stand. To this end, one end of the first lever is linked to the stand, whereas the other end is linked to the second lever. The second lever, the other end of which is journalled in the bearing body of the roller bed roller, is pivotable about a connecting point on the frame.

Figure 1:
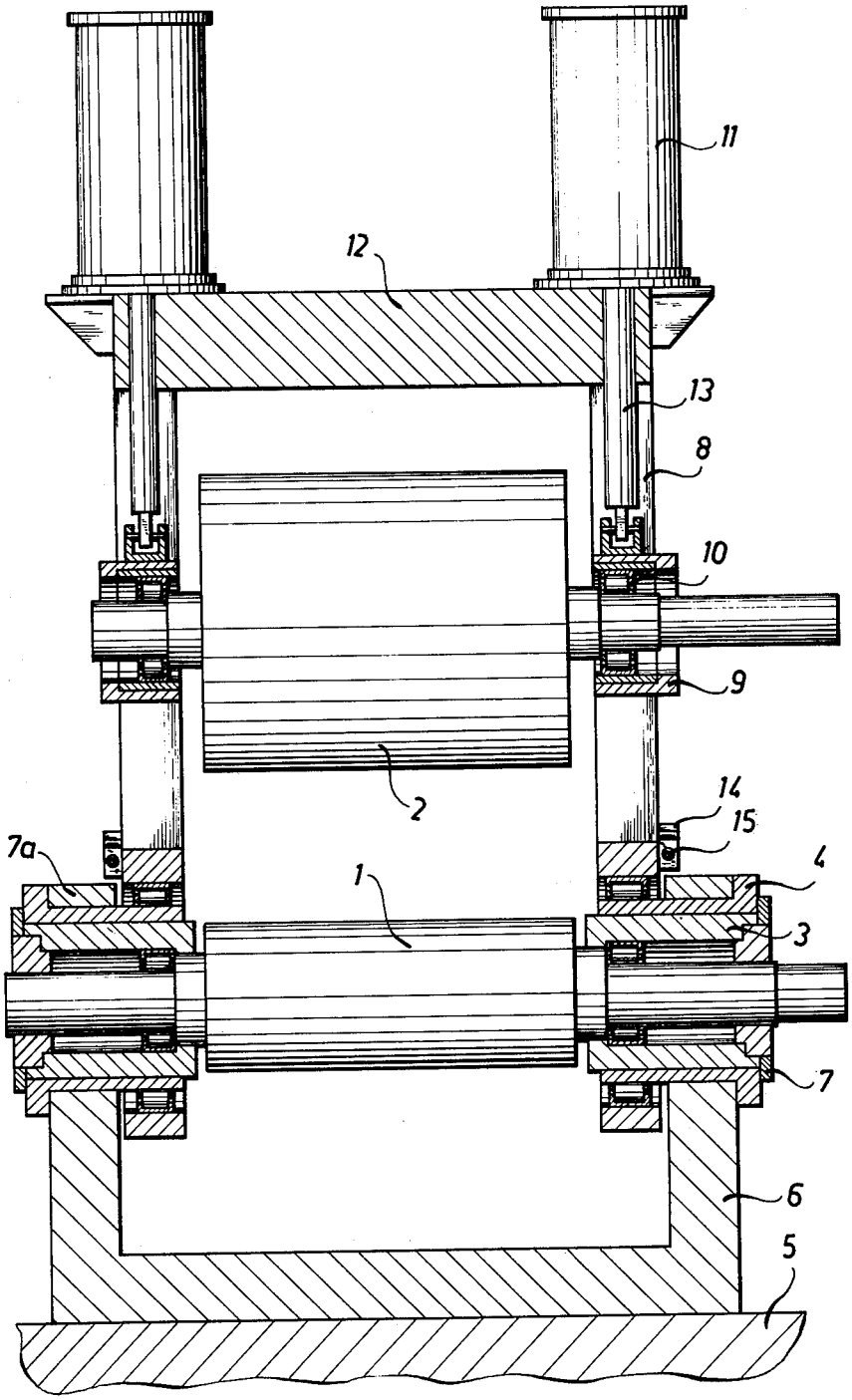
FIG. 1 illustrates a cross section of the device with driving rollers in a passing through position.

Referring now to the drawings in detail, it will be seen from FIG. 1 that the lower driving roller 1 and the upper driving roller 2 have their axes arranged vertically one above the other. The upper driving roller 2 is lifted off the lower driving roller 1 by approximately 500 mm so that bands can safely move between both driving rollers 1, 2 to the next reel.

The lower driving roller 1 is by means of its bearing body 3 and intermediate bushings 4 mounted in a frame 6 arranged on the foundation 5. The lower driving roller 1 is connected by means of bearing covers 7*a*. The bearing bodies 3 and the intermediate bushings 4 are interconnected by rings 7. The upper driving roller 2 on the other hand is mounted in a stand 8 includes lateral trunnions connected to the intermediate bushing 4 of the lower driving roller 1 and is pivotable about the axis of the lower driving roller 1. The upper driving roller 2, which is journalled in inserts 9 and bearings 10, is by means of an air or hydraulic cylinder 11 as well as by a connecting rod 13 operable by the cylinder 11 movable toward the lower driving roller 1. One each of said cylinders 11 is arranged on one side, but on a different side, of the head 12. The connecting rods 13 are connected to the inserts 9.

Figure 2:
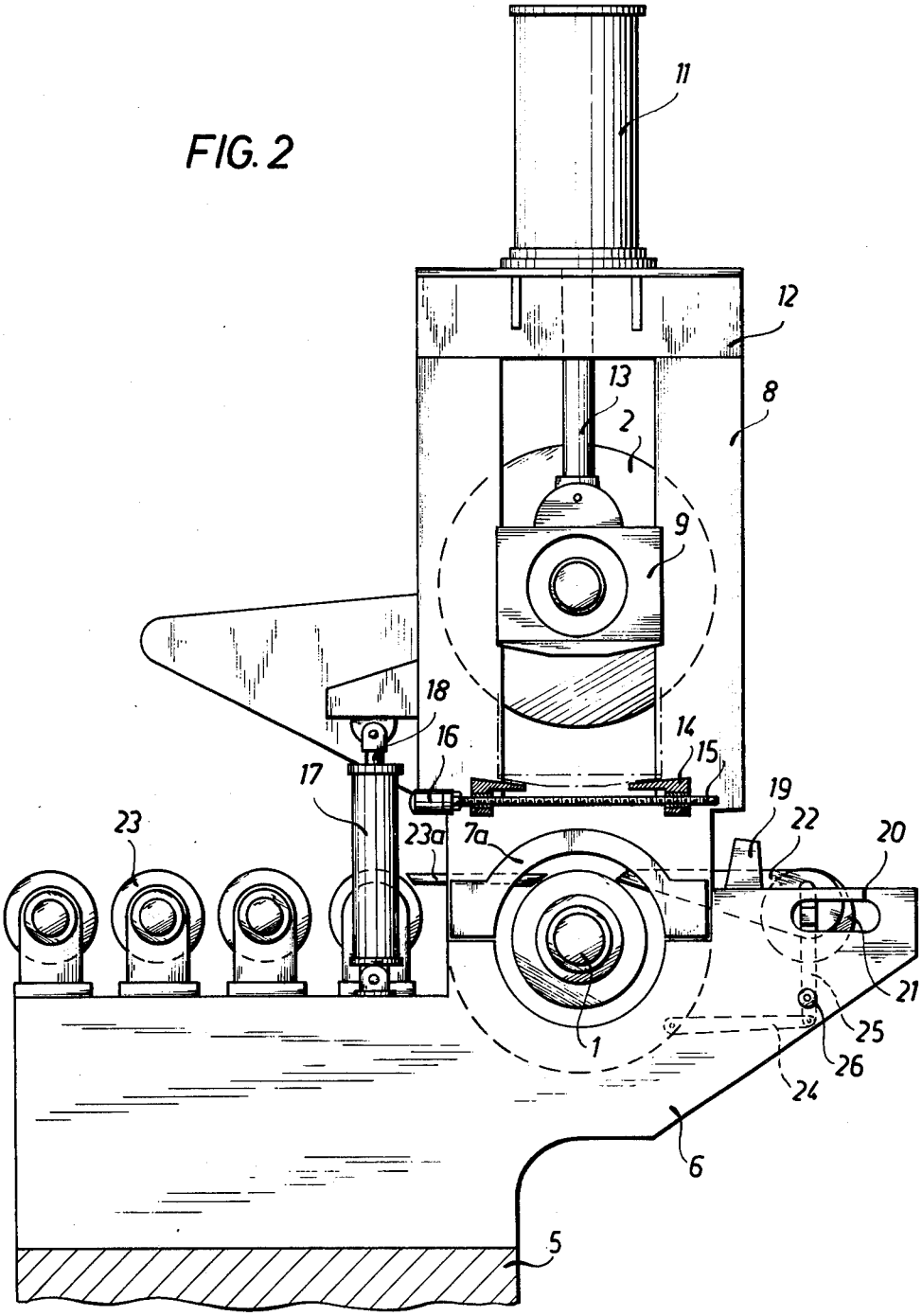
FIG. 2 is a side view of FIG. 1 with driving rollers in their passing through position.

For purposes of finely adjusting the gap between the upper driving roller 2 and the lower driving roller 1, wedge members 14 are provided below the inserts 9 of the upper driving roller 2. The wedge members 14 are arranged on a threaded spindle 15 and are movable by means of a motor 16 (see FIGS. 2, 3 and 4). For purposes of pivoting the upper driving roller 2 about the axis of the lower driving roller 1, two hydraulic cylinder-piston systems 17 are respectively provided on both sides ahead of the stand 8 when viewing the device in the direction in which the band passes through. These cylinder-piston systems should be synchronized in any standard manner. It is, of course, also possible to use only one centrally arranged cylinder-piston system 17. The hydraulic cylinder-piston system 17 is pivotally arranged on frame 6, and its connecting rod 18 is pivotally connected to the stand 8.

The pivoting movement of the stand 8 from the vertical plane is limited to an angle of a maximum of 20° deviation from the vertical plane. This limitation is effected by abutments 19 which are cast onto the frame 6.

Figure 3:
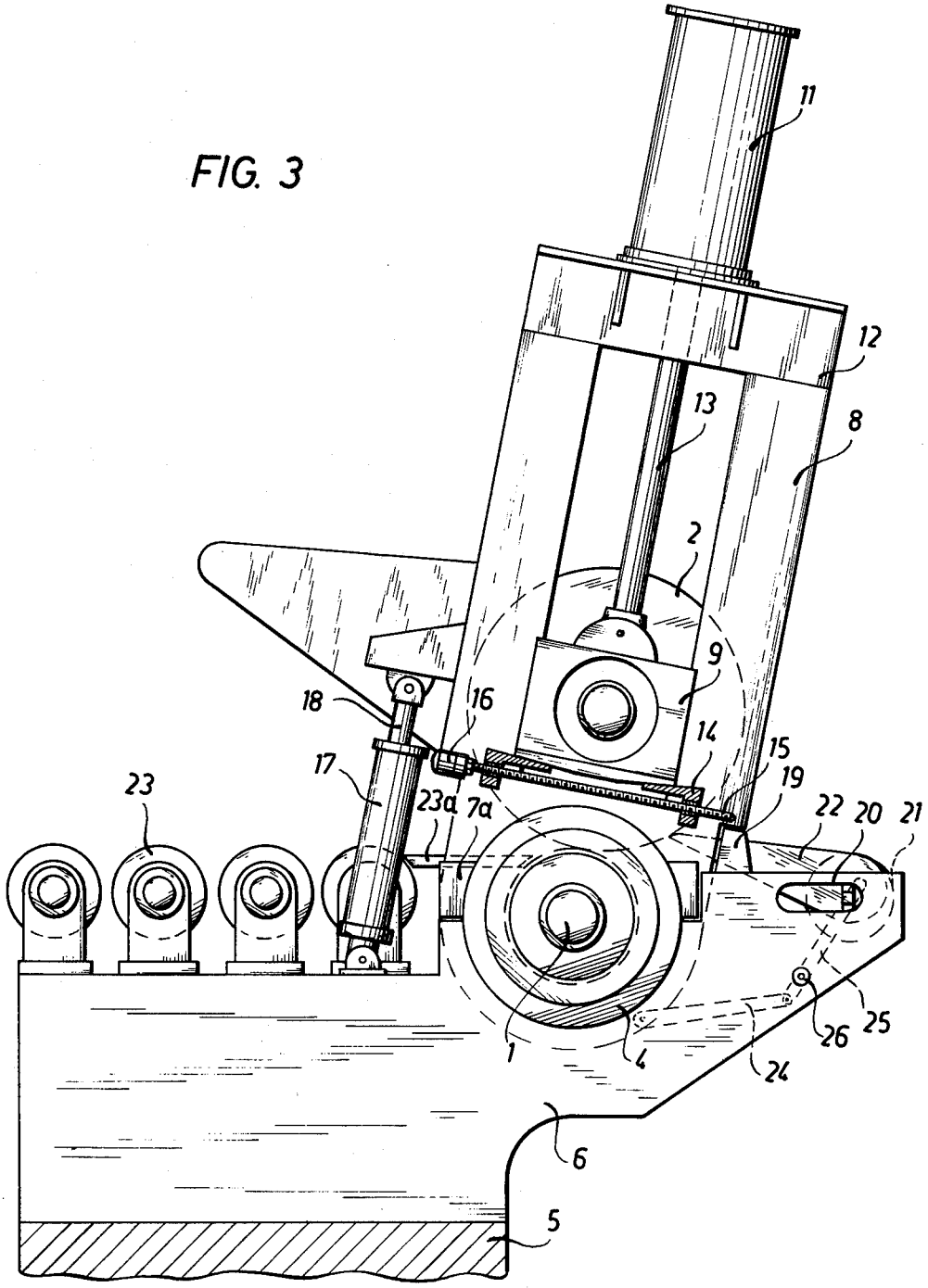
FIG. 3 is a side view of the device according to FIG. 1 with the driving rollers in the moving-in position.
Figure 4:
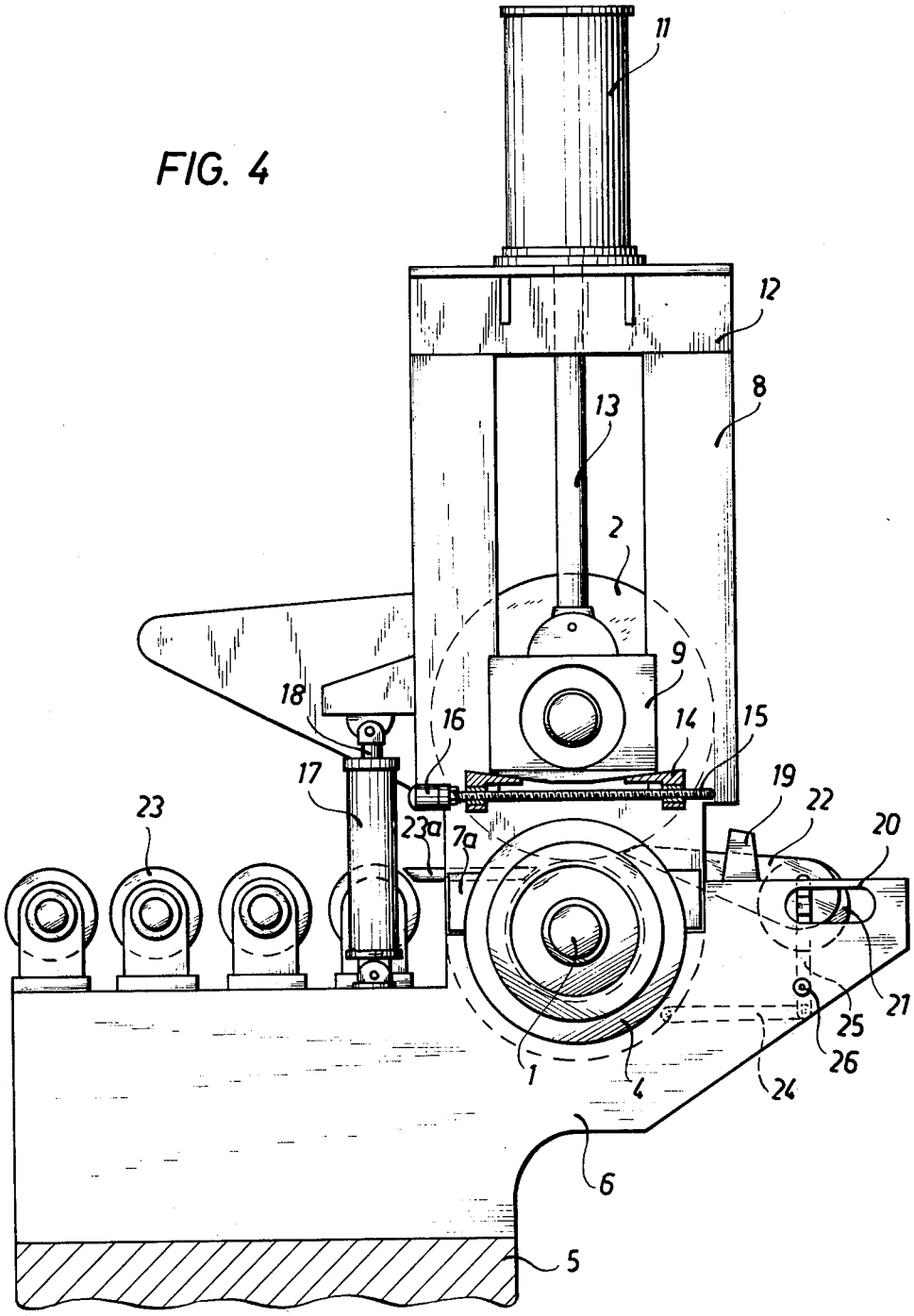
FIG. 4 is a side view of FIG. 1 with the driving rollers in winding position.
Figure 5:
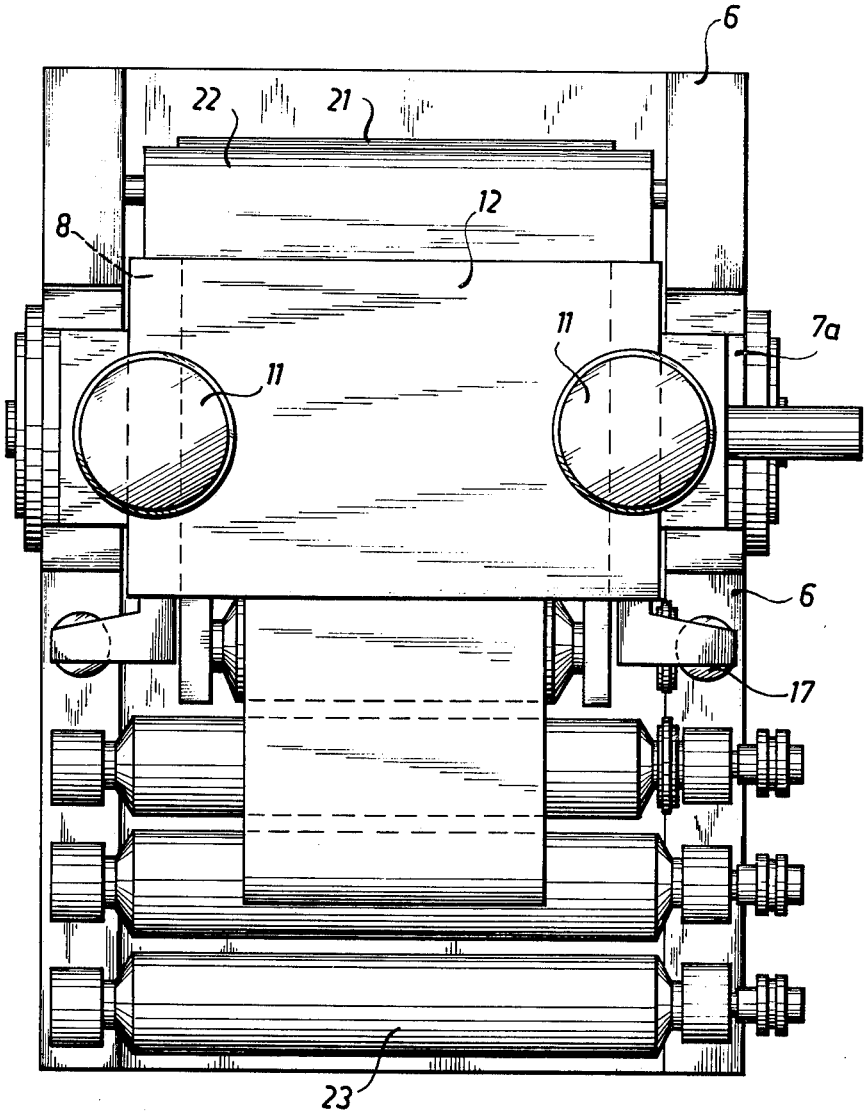
FIG. 5 is a top view of the device according to FIG. 1.

Behind the stand 8 or the driving rollers 1, 2 when viewed in the direction in which the band passes through the device, the frame 6 is provided with an oblong hole guiding element 20 in which the mounting of a roller bed roller 21 is guided. Mounted on the bearing for the roller bed roller 21 is a deviating flap 22 which in the vertical position of the driving device engages the lower driving roller 1 (FIG. 2) or the upper driving roller 2 (FIG. 4) and in each other pivoted position of the driving device rests against the upper driving roller 2 (FIG. 3). Independently of the pivoting movement of the driving device, the deviating flap 22 is by means of a non-illustrated air cylinder connected to frame 6 and engages the axle of the reversing flap 22 moved into these engaging positions. The upper edge of the reversing flap 22 is in vertical position of the driving direction flush with the upper edge of the roller bed roller 21 as well as with the roller bed rollers 23 arranged in front of the driving device and with the inlet table 23a of an outlet roller bed. The movement of the deviating flap 22 is controlled by a lever system 24, 25. One end of the lever 24 is linked to the stand 8 whereas the other end is linked to the lever 25. The lever 25, the other end of which is linked to the bearing of the roller bed roller 21 is pivotable about the connecting point 26 on frame 6.

The stand 8 may be lifted off with the upper driving roller 2, the intermediate bushings 4, the bearing bodies 3 and the lower driving roller 1 in a simple manner. This may be effected by loosening the connecting screws between the bearing covers 7*a* and the frame 6 and may be exchanged by a replacement stand.

As will be evident from the above, the advantage of the driving device according to the present invention consists primarily in that the position of the upper driving roller is fixedly adjustable at any desired point within a predetermined pivoting range, and the gap between the upper and lower driving roller and thereby also the pressing force acting upon the band during the pivoting operation are not changed. In addition thereto, the driving device is, by elimination of the lever arms, of a design which is more sturdy than heretofore known designs of the type involved so that a considerably safer working is made possible. In view of the mounting of the stand with the upper driving roller on the same bushing in which the lower driving roller is located in the interior, a fast exchange of the stand with both driving rollers is possible. Finally, in each pivoting movement of the stand, the shifting flap may be placed against the upper driving roller so that also when the bands follow each other at a rather fast sequence, prior to the completion of the pivoting operation, the next following band is safely introduced to the reel mandrel.

It is, of course, to be understood that the present invention is, by no means, limited to the specific showing in the drawings but also comprises any modifications within the scope of the appended claims.

What we claim is:

1. For use in connection with an underground reel in a rolling mill for band-shaped rolling stock, a two-roll driving device which includes in combination: frame means, a first driving roll rotatably journalled in said frame means, a stand independently pivotable about the axis of rotation of said first roll, a second roll supported by said stand for rolling cooperation with said first roll, adjusting means supported by said stand and operatively connected to said second roll for selectively adjusting said second roll relative to said first roll, and power operable pivoting means operatively connected to said stand independently to pivot the latter and thereby said second roll from a first position in which said second roll and said first roll have their axes of rotation located in an at least approximately common vertical plane to a second position in which their axes of rotation are located in an at least approximately common inclined plane forming an acute angle with said approximately common vertical plane while that part of said inclined plane which extends through said second roll is located behind said common vertical plane when viewing said driving device in the direction in which said first and second rolls are intended to pass the rolling stock to be rolled therethrough, said second roll also being pivotable by said power operable pivoting means from said second position to said first position.

2. A device in combination according to claim 1, which includes first bearing bodies supported by said frame means for rotatably supporting said first roll, bushing means surrounding said first bearing bodies and also supported by said frame means, bearing means supported by said bushing means and pivotally supporting said stand, and abutment means mounted on said frame means for defining said second position.

3. A device in combination according to claim 1, in which said second roll has lateral trunnions and in which said device includes bearing means slidably supported by said stand and supporting said trunnions, said adjusting means including fluid operable cylinder piston means mounted on said stand and also including insert members connected to said cylinder-piston means and surrounding said last mentioned bearing means, said device also including wedge members arranged on the outer bottom side of said insert members and further including spindle and motor means for adjusting said wedge members.

4. A device in combination according to claim 1, in which said power operable pivoting means include fluid operable cylinder-piston means pivotally mounted on said frame means and pivotally connected to said stand.

5. A device in combination according to claim 4, in which said cylinder piston means are driven synchronously.

6. A device in combination according to claim 1, in which independently pivotable deviating flap means are provided at least approximately horizontally displaceably arranged in said frame means and movably connected to said stand.

7. A device in combination according to claim 6, which includes a roller bed roller operatively associated with said deviating flap means, and in which said frame means has an oblong opening for journalling and guiding said roller bed roller for horizontal movement, lever means being pivotally supported by said frame means and being operatively connected to said roller bed roller.

8. A device in combination according to claim 7, in which said lever means include a first and a second lever, one end of said first lever being pivotally connected to said frame means and the other end of said first lever being pivotally connected to one end of said second lever, the other end of said second lever being operatively connected to said roller bed roller, said second lever being pivotally connected to said frame means at a point between its connection with said roller bed roller and with said first lever.

* * * * *